US006341974B1

(12) United States Patent
Konoya

(10) Patent No.: US 6,341,974 B1
(45) Date of Patent: Jan. 29, 2002

(54) CONNECTOR WITH A PARTIAL CONNECTION PREVENTING FUNCTION

(75) Inventor: Hisashi Konoya, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/660,119

(22) Filed: Sep. 12, 2000

(30) Foreign Application Priority Data

Sep. 13, 1999 (JP) ..... 11-258722

(51) Int. Cl.[7] ..... H01R 13/627
(52) U.S. Cl. ..... 439/352; 439/489; 439/354
(58) Field of Search ..... 439/352, 488, 439/489, 354

(56) References Cited

U.S. PATENT DOCUMENTS 5,820,399 A * 10/1998 Shirouzu et al. ..... 439/352
5,993,238 A * 11/1999 Kudo et al. ..... 439/352
6,019,629 A * 2/2000 Ito et al. ..... 439/489

FOREIGN PATENT DOCUMENTS

EP 0 717 465 6/1996
JP 10-134890 5/1998

* cited by examiner

*Primary Examiner*—Tho D. Ta
*Assistant Examiner*—Ann McCamey
(74) *Attorney, Agent, or Firm*—Anthony J. Casella; Gerald E. Hespos

(57) ABSTRACT

A connector includes female and male housings (21, 22) that can be connected with each other. The housings (21, 22) can be separated by placing a finger is on a pushable portion (53) that projects from the upper surface of a slidable member (50) and pushing the slidable member (50) backward against a biasing force of a coil spring (51). Next, a displacement operating portion (36) at the rear end of a locking piece (31) is raised to disengage a locking claw (35) from an engaging portion (55)A. When the female housing (21) is pulled out of the male housing (22) in this state, the housings (21, 22) are separated. The pushable portion (53) of the slidable member (50) and the displacement operating operation (36) of the locking piece (31) are formed so as not to project out from the outer surfaces of the housings (21, 22). Therefore, a deformation and/or damage of the slidable member (50), the locking piece (31) and their neighboring parts by an external force can be prevented.

9 Claims, 9 Drawing Sheets

CONNECTOR WITH A PARTIAL CONNECTION PREVENTING FUNCTION

BACKGROUND OF THE INVENTION

1. Field of the Invention

The present invention relates to a connector with a partial connection preventing function.

2. Description of the Related Art

A connector with a partial connection preventing mechanism is shown, for example, in Japanese Unexamined Patent Publication NO. 10-134890. This prior art connector is identified by the numeral 1 in FIGS. 6 and 7 below, and is provided with female and male housings 2 and 3, which are connectable with each other. The female housing 2 has an upper surface with a locking piece 4 that is vertically elastically deformable. A pushing portion 5 projects from an upper surface of the locking piece 4 and can push a slidable member 13, which is described later. Wing-like projections 6 are provided on the left and right edges of the locking piece 4. Each projection 6 has a slanted guide surface 6A on its front face.

The front surface of the male housing 3 is provided with a receptacle 8 into which the female housing 2 can be fit. Left and right guides 9 project from the upper surface of the receptacle 8. The guides 9 have inwardly projecting engaging portions 10 for engaging the corresponding projections 6 of the locking piece 4. Slanted guide surfaces 10A, 10B are formed at the front and rear ends of each engaging portion 10 for guiding the projections 6. Further, a slide groove 11 extends into the rear of the upper surface of the male housing 3 and is configured to receive the slide 13. The slide 13 has a substantially H-shaped cross section, and can be slid along forward and backward directions on the male housing 3 by holding the edges of the slide groove 11 in groove portions 14 at the left and right sides of the slide 13. An upper part of the slide 13 projects upward from the upper surface of the male housing 3 and defines a pushable portion 15. A finger-engageable operable projection 15A projects at the rear end of the pushable portion 15 and a zigzag spring 16 is mounted behind the slide 13, so that the slide 13 is constantly biased forward. A cover 17 is mounted on the male housing 3 for locking the slide 13 and the spring 16 against backward movement.

The prior art female housing 2 is fitted into the receptacle 8 of the prior art male housing 3 so that the guide surfaces 6A of the left and right projections 6 of the locking pieces 4 contact the guide surfaces 10A of the engaging portions 10. As a result, the locking piece 4 deforms elastically upward to bring the pushing portion 5 into contact with the front end face of the slide 13. The female housing 2 can be pushed further so that the pushing portion 5 compresses the spring 16 and pushes the slide 13 backward, as shown in FIG. 8. When the projections 6 of the locking piece 4 move over the engaging portions 10, the locking piece 4 is restored elastically to its original position to engage the projections 6 and the engaging portions 10. The slide 13 then is returned forward to restrict deformation of the locking piece 4 in a disengaging direction (upward). As a result, the housings 2 and 3 are locked in their properly connected state. If the connecting operation of the prior art housings 2 and 3 is interrupted halfway, the pushing portion 5 of the locking piece 4 is biased by the slide 13, thereby pushing the female housing 2 out. In this way, a partial connection is prevented.

To disconnect the properly connected prior art housings 2 and 3, a finger is placed on the pushable portion 15 to push the slide 13 against a biasing force of the spring 16. If the female housing 2 is withdrawn in this way, the projections 6 of the locking piece 4 move up along the guide surfaces 10B of the engaging portions 10, thereby elastically deforming the locking piece 4 upward. The housings 2 and 3 are separated upon completely withdrawing the female housing 2. If the separating operation of the housings 2 and 3 is interrupted halfway, the spring 16 pushes the slide 13 against the pushing portion 5 of the locking piece 4 and urges the female housing 2 out. This prevents the housings 2 and 3 from being left partly connected.

The pushable portion 15 projects out from the outer surface of the prior art male housing 3. Thus, an external matter may be struck against the pushable portion 15 to exert an external force on the slide 13, or on portions of the housings 2, 3 near the pushable portion 15, thereby deforming and/or damaging them.

In view of the above problem, an object of the present invention is to provide a connector that can prevent a projecting operable portion, such as a slide and their neighboring members, from being deformed and damaged.

SUMMARY OF THE INVENTION

The subject invention is directed to a connector that comprises first and second housings, each of which has a front side. The housings are at least partly connectable with each other at their front sides. A slide is provided at least partly in the first housing, and can be slid in the connecting directions of the housings. Additionally, the slide is biased forward in the first housing by a biasing means. A locking piece is provided in the second housing and can engage an engaging portion to hold the housings in a properly connected condition. The slide can interact with the locking piece to restrict movement of the locking piece in a disengaging direction from the engaging portion. A pushable portion projects from the slide, and is operable to push the slide up to a position where a disengaging movement of the locking piece from the engaging portion is permitted. The pushable portion does not project out from the outer surface of the first housing, and therefore, is not likely to be struck by external matter.

According to a preferred embodiment, the locking piece is elastically displaceable in a direction substantially normal to the connecting directions of the housings. Additionally, the locking piece pushes the slide against the biasing means while the housings are being connected, and then moves onto the engaging portion that projects in the first housing. The locking piece moves over the engaging portion when the housings are properly connected, and then the locking piece is restored elastically to engage the engaging portion and hold the housings in a properly connected condition.

A biasing force of the biasing means moves the slide forward as the locking piece is restored elastically to its locking position. The sliding member also may be restored elastically and positioned substantially outside the locking piece to restrict elastic deformation of the locking piece in a disengaging direction from the engaging portion.

The first housing may be formed with a slide-accommodating portion for at least partly accommodating the slide, such that the slide is movable along the connecting directions of the housings or in the forward and backward directions of the first housing. The slide-accommodating portion preferably has an operation opening to enable operation of the pushable portion. The pushable portion preferably is exposed to the outside without projecting out from an opening edge of the operation opening. Accordingly, external matter is not likely to contact the slide, and hence the slide and its neighboring parts are not likely to be damaged.

A displacement-operating portion may project from the locking piece for unlocking the locking piece, and may be formed so as not to project out from the outer surface of the other housing. Accordingly, external matter is not likely to contact the displacement-operating portion of the locking piece, and hence the locking piece and its neighboring parts are not likely to be deformed and damaged by an external force.

These and other objects, features and advantages of the present invention will become apparent upon reading of the following detailed description of preferred embodiments and accompanying drawings.

DETAILED DESCRIPTION OF THE PREFERRED EMBODIMENTS

Figure 1:
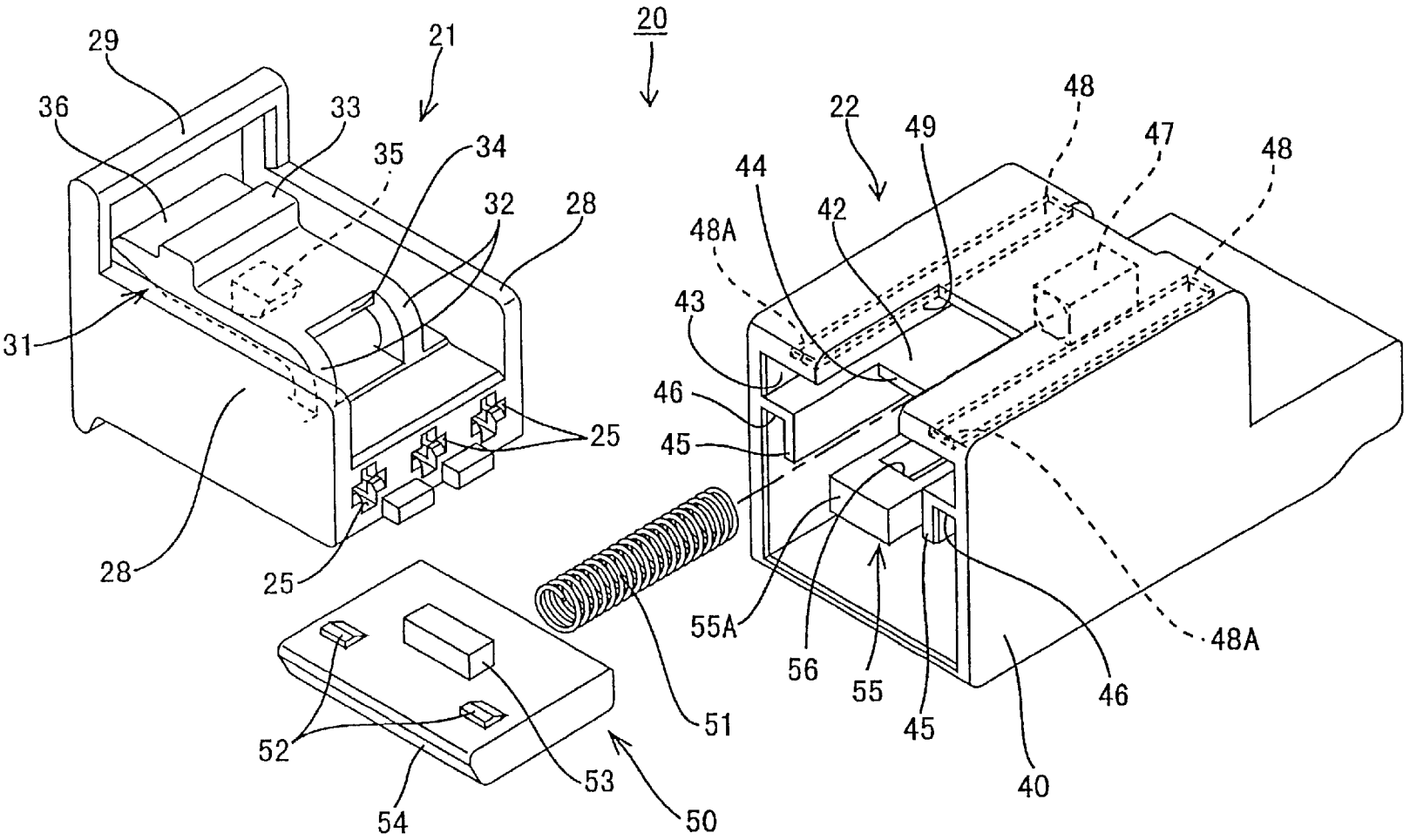
FIG. 1 is an exploded perspective view of a connector according to one embodiment of the invention.
Figure 2:
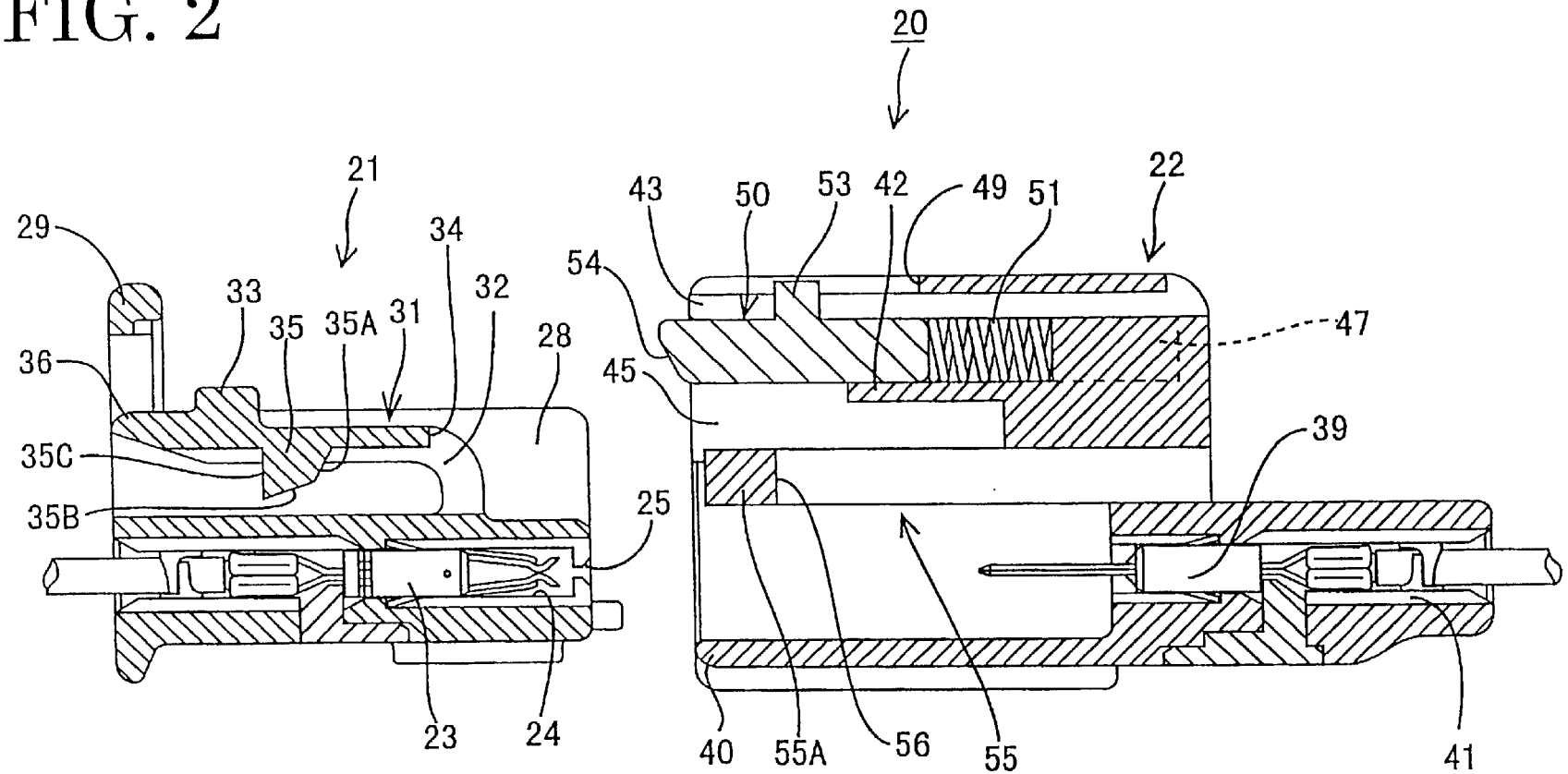
FIG. 2 is a side view in section showing female and male housings before being connected.

A connector according to the invention is identified generally by the numeral 20 in FIGS. 1 to 5. The connector 20 is provided with a female housing 21 and a male housing 22, which can be engaged at least partly with each other as shown in FIGS. 1 and 2. Sides of the female and male housings 21 and 22 that are to be connected are referred to as the fronts in the following description.

The female housing 21 is formed e.g. of a synthetic resin and has a substantially rectangular parallelepiped shape. Cavities 24 are arranged substantially side by side in the connector housing, and are configured for accommodating female terminal fittings 23. A tab insertion opening 25 is open in the front surface of each cavity 24. When the female and male housings 21 and 22 are connected, the leading ends of male terminal fittings 39 provided in the male housing 22 are inserted into the cavities 24 through the respective tab insertion openings 25. Thus the male terminal fittings 39 are connected with the female terminal fittings 23.

Guide walls 28 project respectively at the left and right edges of the upper surface of the female housing 21, and a substantially rectangular frame 29 connects the rear ends of the guide walls 28. A locking piece 31 is provided between the left and right guide walls 28. The locking piece 31 is coupled to the upper surface of the female housing 21 via left and right legs 32. The legs 32 extend up from a location near the front the female connector housing 21, and then extend substantially horizontally or longitudinally backward. The locking piece 31 is vertically elastically displaceable by deforming the legs 32. A rear end portion of the locking piece 31 serves as a displacement-operating portion 36 under which a finger can be placed to raise the locking piece 31. Alternatively or additionally, a jig may be used to manipulate or operate the locking piece 31. The displacement-operating portion 36 is formed so as not to project out from the frame portion 29 at the rear surface of the female housing 21.

A pushing portion 33 projects upwardly from a location near the rear end of the locking piece 31 and is operative to push a slide 50, as described below. An insertion hole 34 is formed between the left and right legs 32 of the locking piece 31, and is configured to receive an interlocking portion 55 that projects from the male housing 22. Further, a locking claw 35 projects from the lower surface of the locking piece 31 for engagement with an engagement portion 55A of the interlocking portion 55. The interlocking portion 55 and its engaging portion 55A are described later. The lower surface of the locking claw 35 is formed by two surfaces that have different inclinations, namely, a front surface that serves as a more steeply inclined guide surface 35A and a rear surface that serves as a more moderately inclined bottom surface 35B. The rear end surface of the locking claw 35 preferably is a substantially vertical engaging surface 35C, which contacts the interlocking portion 55 when the locking claw 35 and the engaging portion 55A are engaged with each other.

The male housing 22 is formed e.g. of a synthetic resin, and has a substantially rectangular parallelepiped shape. More particularly, the male housing 22 is provided at its front surface with a receptacle 40 that extends into the front surface of the male housing 22. The receptacle 40 is dimensioned to receive at least part of the female housing 21. Cavities 41 are arranged substantially side by side in a rear part of the receptacle 40. The male terminal fittings 39 are accommodated in the cavities 41, such that the leading ends of the male terminal fittings 39 project into the receptacle 40.

The interlocking portion 55 projects forward from the back surface of the receptacle 40, and can be inserted through the insertion hole 34 of the locking piece 31. The interlocking portion 55 is formed with an elongate lock hole 56 aligned substantially along forward and backward directions, and a front end of the interlocking portion 55 serves as the engaging portion 55A for engaging the locking claw 35 of the locking piece 31.

A partition wall 42 is provided in an upper portion of the receptacle 40, and a slide-accommodating portion 43 is defined above the partition wall 42 for accommodating the slide 50, as described later. A groove 44 is formed in a front part of the partition wall 42 and is dimensioned to receive at least part of the locking piece 31. Guides 45 extend down from the left and right edges of the groove 44, and guide grooves 46 are defined between the guides 45 and the left and right side walls of the receptacle 40. The guide walls 28 of the female housing 21 can be inserted at least partly into the guide grooves 46.

A hollow substantially rectangular spring mount portion 47 is provided in the middle of the back part of the slide-accommodating portion 43, and a coil spring 51 or comparable biasing means is mountable in the spring mount portion 47 for biasing the slide 50 forward.

Grooves 48 extend in forward and backward directions at the left and right sides of the ceiling surface of the slide-accommodating portion 43, and a pair of locking projections 52 on the slide 50 are at least partly fit in the grooves 48. The front ends of the grooves 48 do not extend up to the front surface of the male housing 22, and thereby form front stops 48A. The locking projections 52 of the slide 50 contact the front stops 48A so that the slide 50 is limited in its movement and does not come out of the slide-accommodating portion 43. An operation opening 49 is formed in the upper wall of the slide-accommodating portion 43 and extends from the front end to a middle position of this upper wall.

The slide 50 is formed e.g. of a synthetic resin into the shape of a substantially flat plate, and has a pair of wedge-shaped locking projections 52 near the left and right front ends of the upper surface thereof. The wedge-shaped locking projections 52 can be fit into the grooves 48 to lock the slide 50 in the slide-accommodating portion 43. The slide 50 can be slid in forward and backward directions inside the slide-accommodating portion 43, and is constantly biased forward by the coil spring 51 at the back of the slide-accommodating portion 43. An elongate pushable portion 53 extends transversely from the center of the upper surface of the slide 50. The pushable portion 53 projects at least partly into the operation opening 49 of the male housing 22 when the housings 21 and 22 are connected. The slide 50 can be pushed backward against a biasing force of the coil spring 51 by placing a finger and/or an operating jig on the pushable portion 53. The pushable portion 53 preferably is exposed to the outside without projecting out from an opening edge of the operation opening 49. A front end surface 54 of the slide 50 is inclined so that the pushing portion 33 of the locking piece 31 can be slid easily down or toward the female connector housing 21, as described later.

Figure 3:
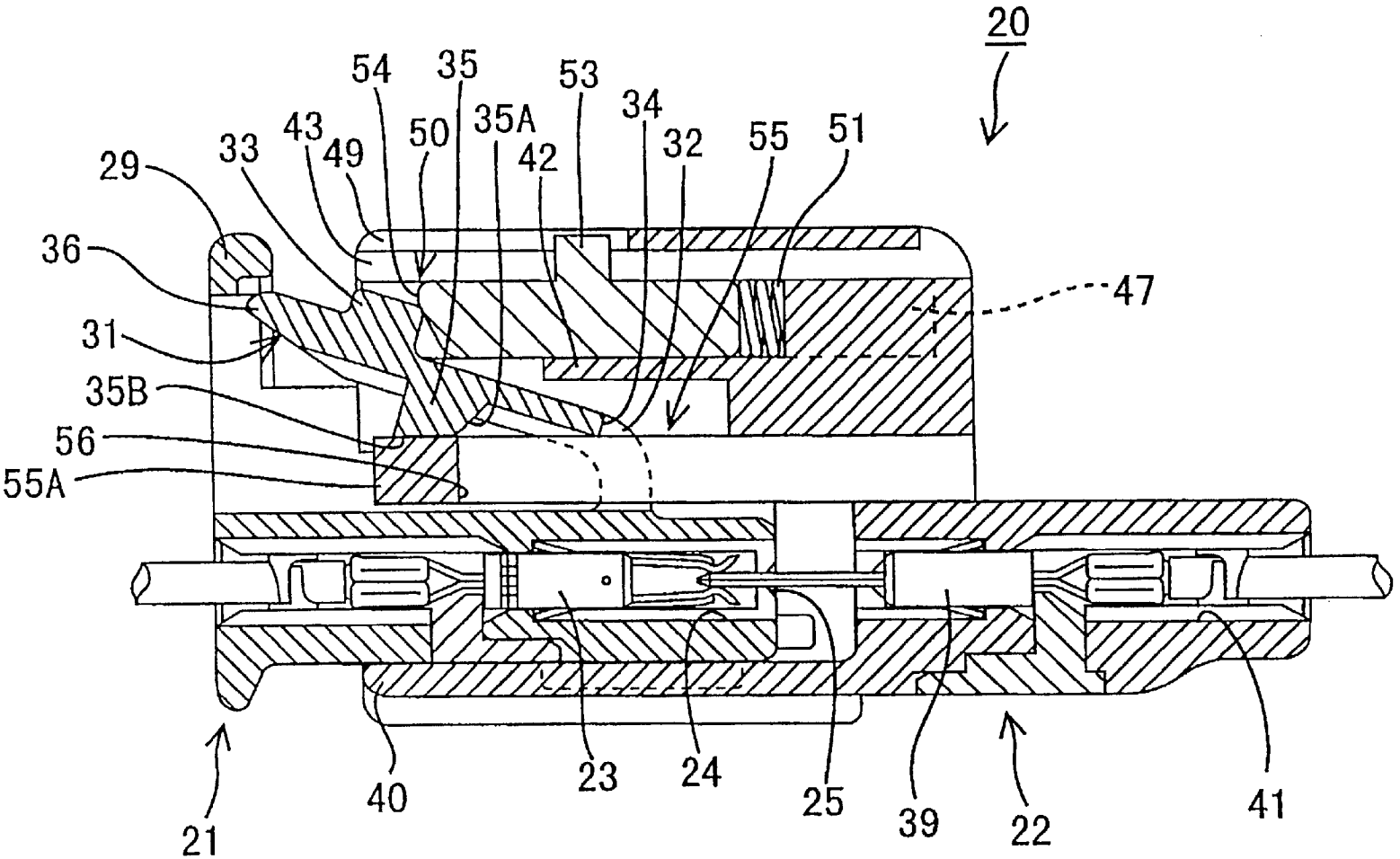
FIG. 3 is a side view in section showing the female and male housings during a connecting operation.

The female and male housings 21 and 22 are connected by initially fitting the left and right guide walls 28 of the female housing 21 into the respective guide grooves 46 of the receptacle 40 of the male housing 22. After sufficient insertion, the leading end of the interlocking portion 55 passes through the insertion hole 34 near the base end of the locking piece 31, and contacts the locking claw 35. The locking claw 35 is guided onto the interlocking portion 55 by the guide surface 35A, and the locking piece 31 is displaced elastically upward. As a result, the locking claw 35 moves onto the upper surface of the engaging portion 55A of the interlocking portion 55 while the bottom surface 35B of the locking claw 35 is held in contact with the upper surface 55A if the interlocking portion 55, as shown in FIG. 3. At this time or in the deflected position, the pushing portion 33 contacts the front face 54 of the slide 50 at the upper surfaces of the housings 21, 22. Accordingly, further insertion of the female housing 21 pushes the slide 50 backward against the biasing force of the coil spring 51.

Figure 4:
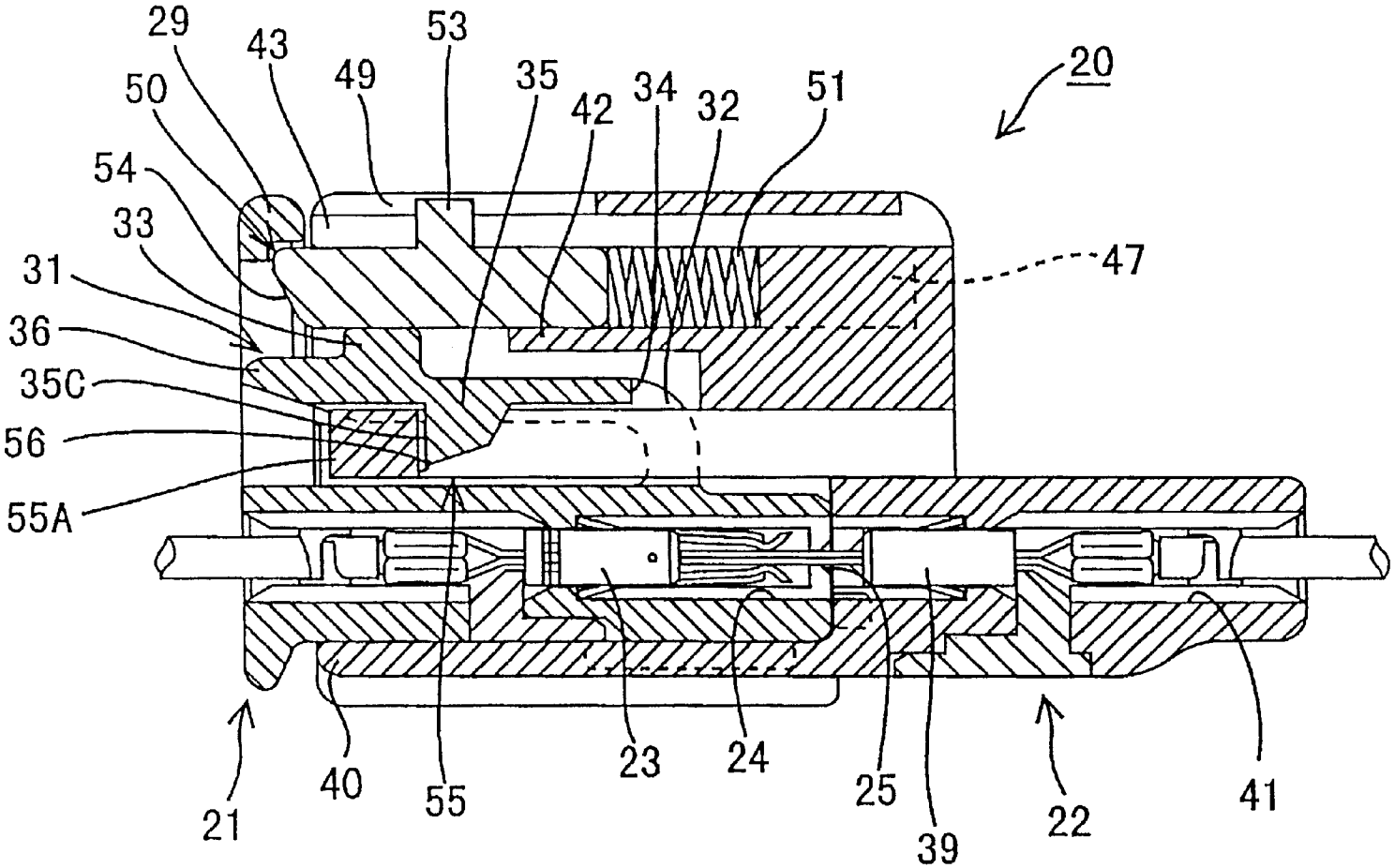
FIG. 4 is a side view in section showing the female and male housings properly connected.

The locking claw 35 moves over the engaging portion 55A of the interlocking portion 55 substantially as the female housing 21 reaches its proper position. At this point, the locking piece 31 is restored elastically to its natural state with no external force acting on the locking piece 31. Additionally, the locking claw 35 enters the lock hole 56 to engage the engaging portion 55A, as shown in FIG. 4. The pushing portion 33 and the front surface 54 of the slide 50 disengage from each other as the locking piece 31 is restored elastically. As a result, the slide 50 is returned substantially to its front position by the elastic restoring force of the coil spring 51. When the slide 50 is returned to its front position, the locking piece 31 is in a position where the upper surface of the pushing portion 33 is in contact with the lower surface of the slide 50. Thus, the slide 50 restricts an elastic displacement of the locking piece 31 in a disengaging direction (upward) from the interlocking portion 55, and the housings 21, 22 are locked in their properly connected state.

In this properly connected state, the pushable portion 53 of the slide 50 does not project out from the opening edge of the operation opening 49, and the displacement operating portion 36 of the locking piece 31 does not project out from the rear end edge of the female housing 21.

The housing connecting operation conceivably could be interrupted with the housings 21 and 22 connected only partly, as shown in FIG. 3. In this situation, the coil spring 51 biases the slide 50, such that the pushing portion 33 of the locking piece 31 pushes the female housing 21 out of the receptacle 40. In this way, a partial connection is prevented.

Figure 5:
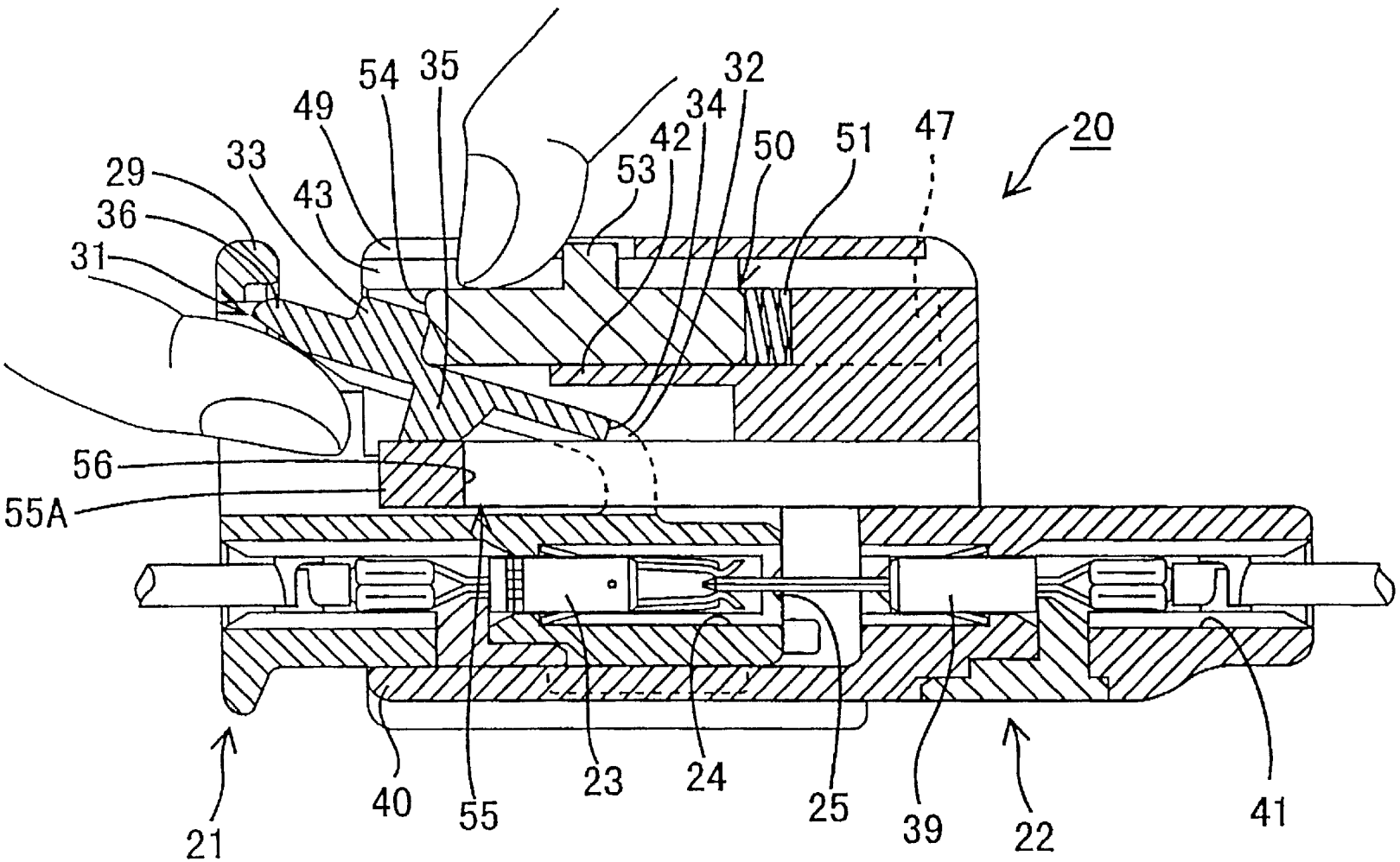
FIG. 5 is a side view in section showing the female and male housings during a separating operation.
Figure 6:
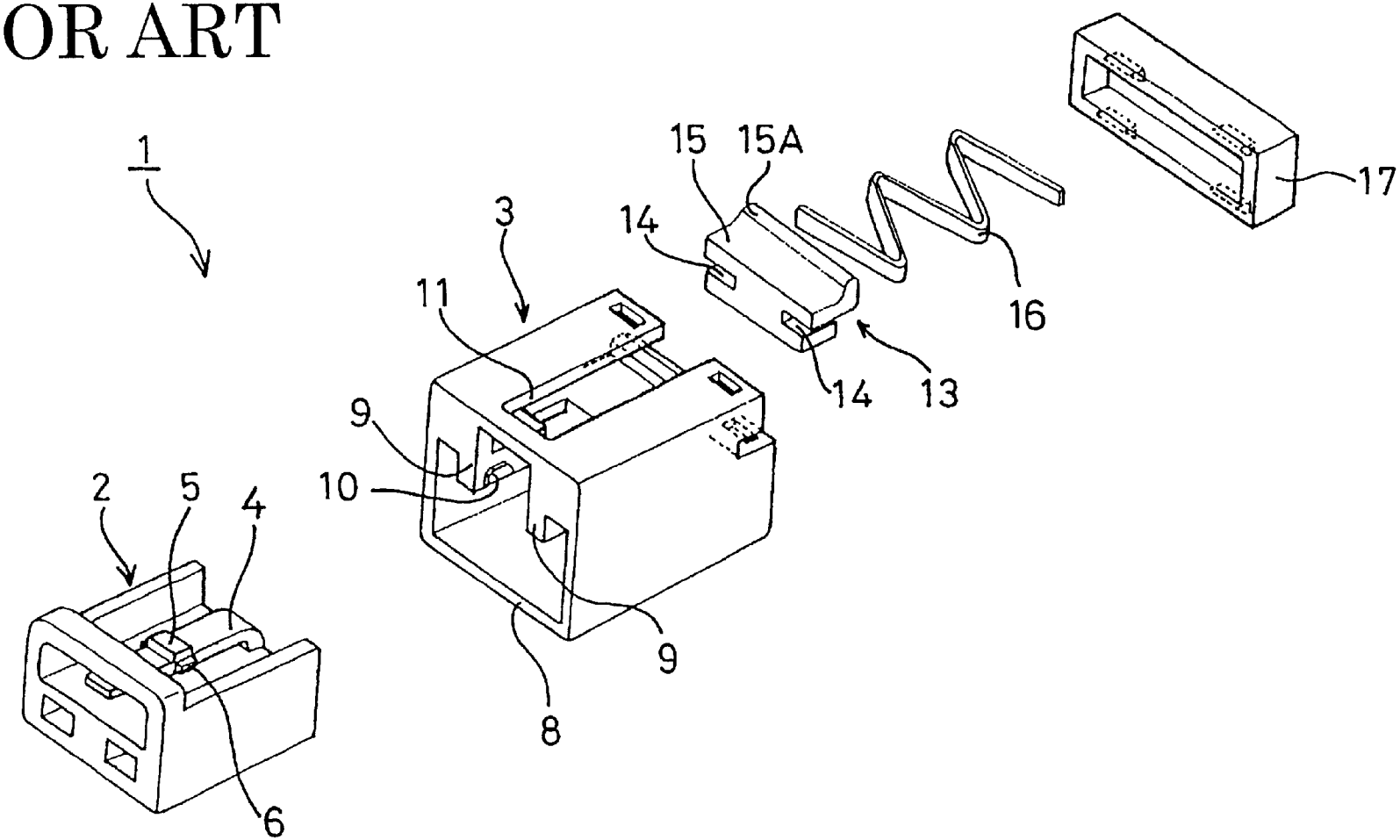
FIG. 6 PRIOR ART
FIG. 6 is an exploded perspective view of a prior art connector.
Figure 7:
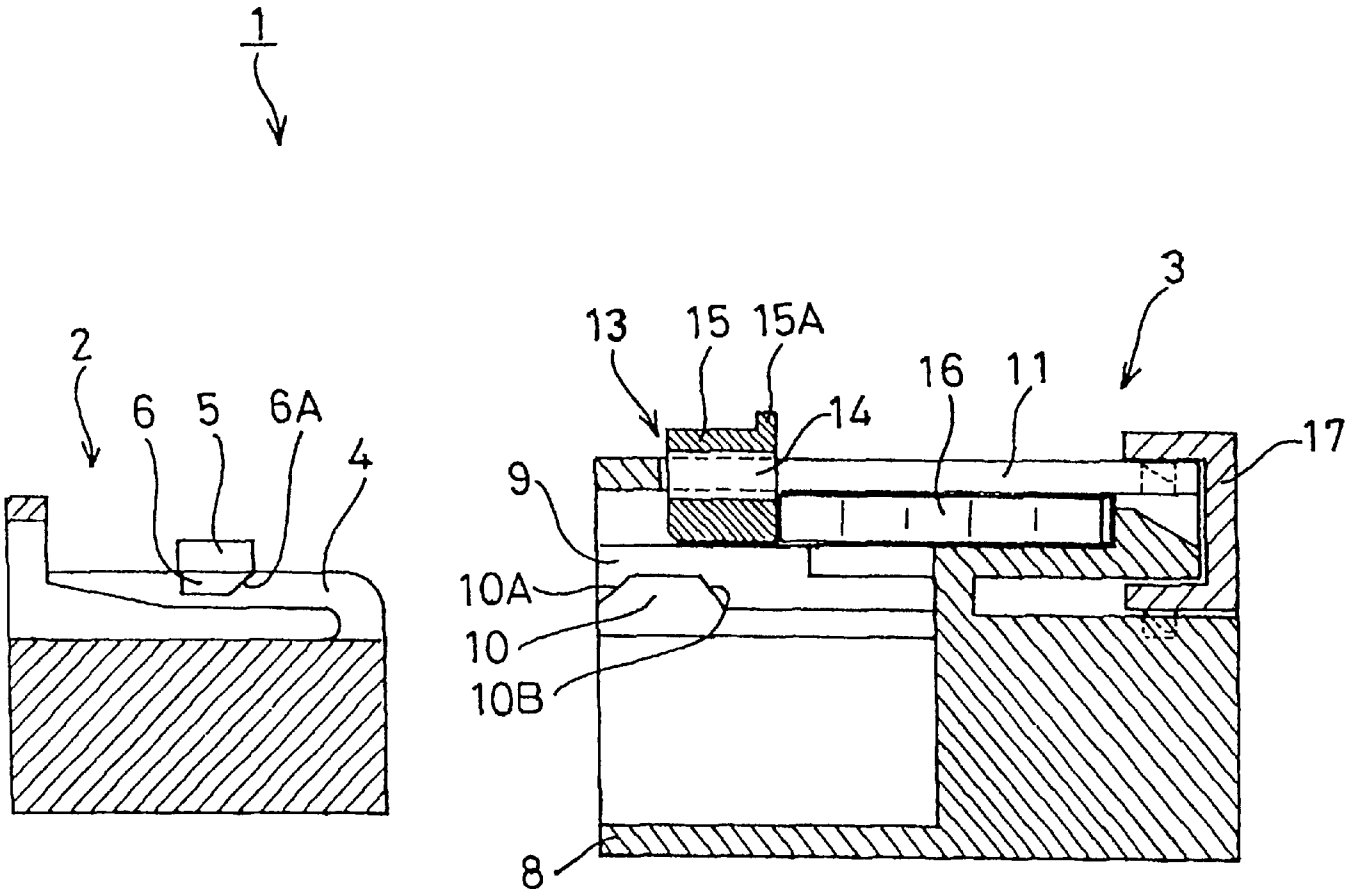
FIG. 7 PRIOR ART
FIG. 7 is a side view in section showing female and male housings of the prior art connector before being connected.
Figure 8:
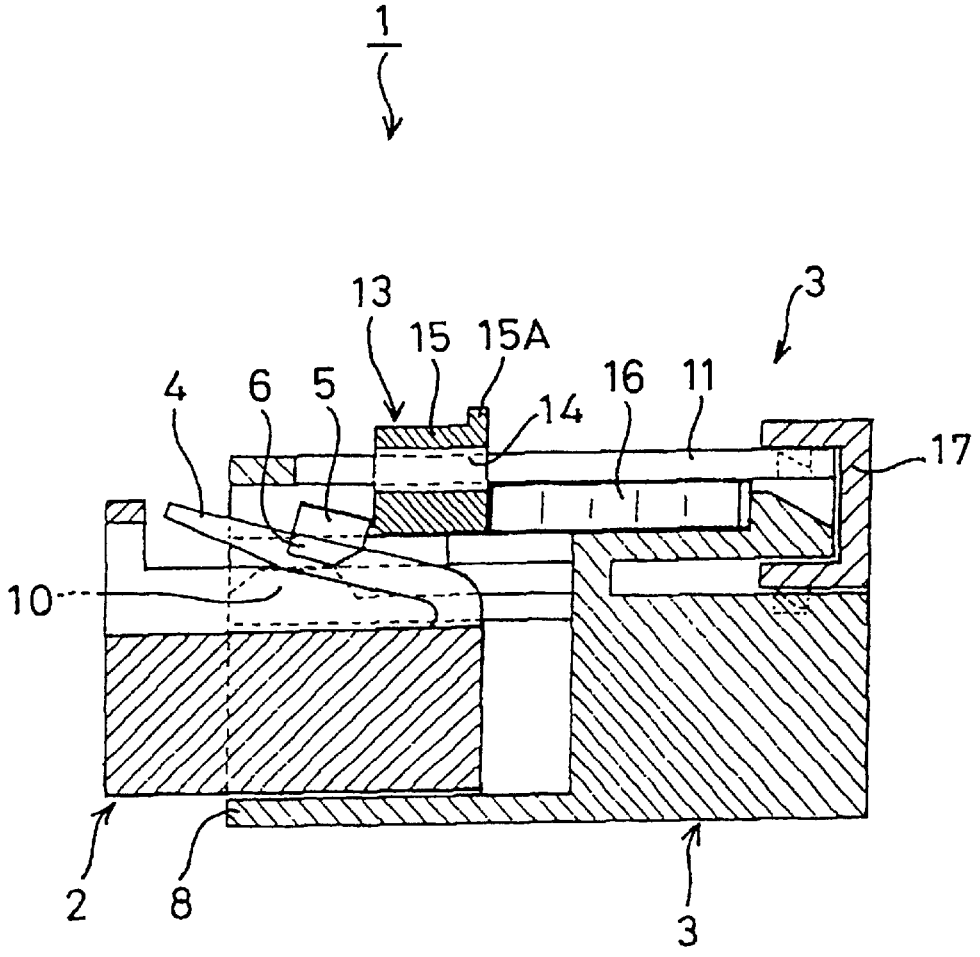
FIG. 8 PRIOR ART
FIG. 8 is a side view in section showing the female and male housings of the prior art connector during a connecting operation.
Figure 9:
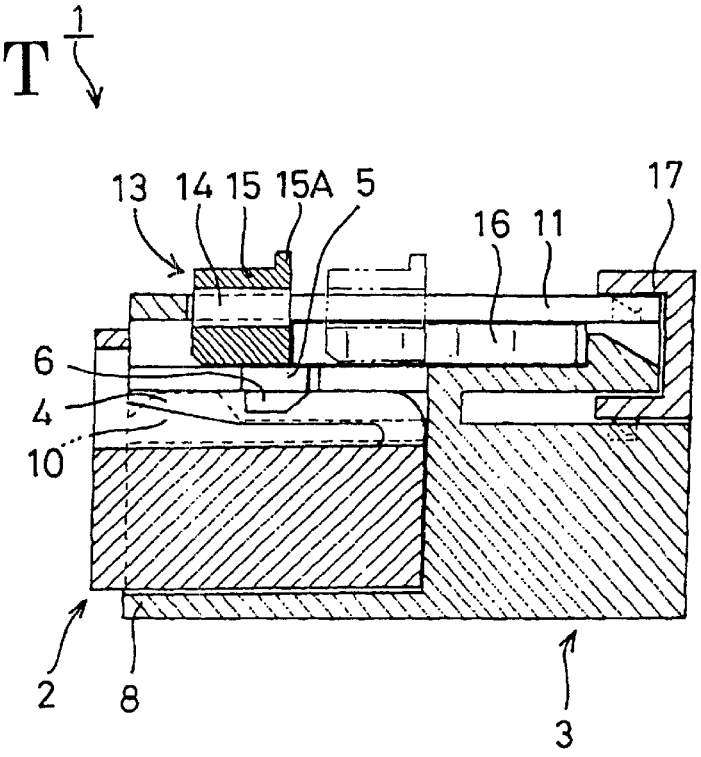
FIG. 9 PRIOR ART
FIG. 9 is a side view in section showing the female and male housings of the prior art connector properly connected.
Figure 10:
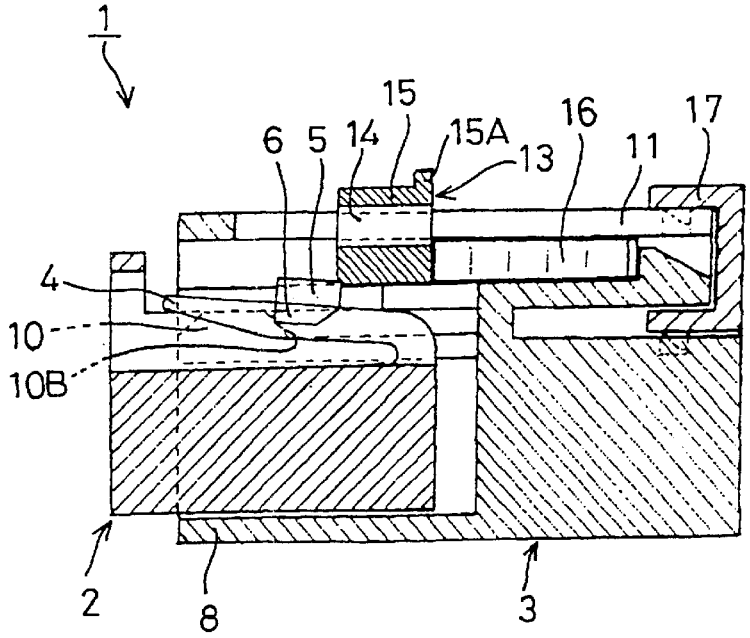
FIG. 10 PRIOR ART
FIG. 10 is a side view in section showing the female and male housings of the prior art connector during a separating operation.

The properly connected housings 21 and 22 can be separated by placing a finger on the pushable portion 53 of the slide 50 to push the slide 50 backward against the biasing force of the coil spring 51 (see FIG. 5). Another finger then is placed below the displacement-operating portion 36 of the locking piece 31 while the slide 50 is held in the above-described position. Thus, the locking piece 31 is displaced elastically upward to disengage the locking claw 35 from the engaging portion 55A of the interlocking portion 55. Then, the female housing 21 is pulled in this state to cause the locking claw 35 to move onto the upper surface of the engaging portion 55A of the interlocking portion 55. Further pulling will separate the female housing 21 from the male housing 22.

If the housing separating operation is interrupted halfway while the housings 21 and 22 still are connected partly, as shown in FIG. 5, the coil spring 51 biases the slide 50 to push the pushing portion 33 of the locking piece 31 and to urge the female housing 21 out of the receptacle 40. This prevents the housings 21, 22 from being left partly connected while they are being separated.

According to this embodiment, the slide 50 is accommodated in the slide-accommodating portion 43 for movement in forward and backward directions. Additionally, the pushable portion 53 does not project out from the opening edge of the operation opening 49, and therefore, external matter is unlikely to contact the slide 50. Accordingly, deformation and/or damage of the slide 50 and its neighboring parts by an external force can be prevented.

Further, since the displacement operating portion 36 of the locking piece 31 does not project out from the outer surface of the female housing 21, external matter is unlikely to contact the displacement operating portion 36, which can prevent the locking piece 31 from being deformed and/or damaged by an external force.

The present invention is not limited to the above embodiment. For example, the following embodiment also is embraced by the technical scope of the invention as defined in the claims. Besides this embodiment, various changes can be made without departing from the scope and spirit of the invention as defined in the claims.

Although the displacement operating operation 36 of the locking piece 31 does not project out from the outer surface of the female housing 21 in the foregoing embodiment, it may not be provided or it may project out from the outer surface of the housing if being provided according to the invention.

In the case that the displacement-operating portion of the locking piece is not provided, a guide surface is provided, for example, on the rear surface of the locking claw 35 or on the inner surface of the engaging portion 55A of the interlocking portion 55. The guide surface extends in a direction to deform the locking piece 31 elastically upward when the housings 21, 22 are pulled in separating directions. In this way, the housings 21, 22 may be made separable even without a locking piece disengaging operation.

What is claimed is:

1. A connector, comprising:

a first housing having a front side, a second housing having a front side, the first and second housings being at least partly connectable with each other at their front sides by relative movement of at least one of said housings along connecting directions, an engaging portion disposed in the second housing, the engaging portion including a locking hole, a locking piece provided in the first housing for engagement with the engaging portion to hold the housings in a properly connected condition, the locking piece comprising a pair of spaced-apart legs projecting from an outer surface of the first connector housing, the legs being spaced sufficiently apart for the engaging portion to pass between the legs as the housings are being connected, the locking piece further including a locking claw projecting downwardly toward the first connector housing and being engageable in the locking hole when the housings are in the properly connected condition, a slide provided at least partly in the second housing and being slidable in the connecting directions of the housings between a first position where the slide permits disengagement of the locking piece from the engaging portion and a second position where the locking piece restricts disengagement of the locking piece from the engaging portion, a biasing member for biasing the slide toward the second position, and a pushable portion projecting from the slide and being engageable to push the slide to the first position where disengagement of the locking piece from the engaging portion is permitted, wherein the pushable portion is formed so as not to project out from outer surface regions of the first housing.

2. A connector according to claim 1, wherein the locking piece is disposed for elastic displacement in a direction substantially normal to connecting directions of the housings, the locking piece being configured for pushing the slide against the biasing member while the housings are being connected, and being restored elastically to engage the engaging portion when the housings are connected properly, thereby holding the housings in a properly connected condition.

3. A connector according to claim 1, wherein the second housing includes a receptacle, the front side of the first housing being receivable in the receptacle, the engaging portion projecting into the receptacle.

4. A connector according to claim 1, wherein a displacement operating portion projects from the locking piece for unlocking the locking piece, the displacement operating portion being formed so as not to project out from the outer surface of the first housing.

5. A connector according to claim 1, wherein the second housing has an operation opening, the pushable portion being accessible through the operation opening.

6. A connector according to claim 1, wherein the second housing is formed with a slide-accommodating portion for at least partly accommodating the slide.

7. A connector according to claim 6, wherein the slide-accommodating portion has an operation opening for receiving the pushable portion, the pushable portion being exposed to the outside at the operation opening for manual activation of the pushable portion.

8. A connector according to claim 1, wherein the locking claw includes a tapered front face for generating deflection of the locking piece in response to movement against the engaging portion during connection of the housings.

9. A connector according to claim 8, wherein the locking piece includes a pushing portion for engaging the slide and pushing the slide against the biasing member when the locking piece is deflected by the locking claw, the slide being moved over the pushing portion by the biasing member when the housings are properly connected and when the locking piece returns to an undeflected condition, such that engagement of the slide with the pushing portion prevents deflection of the locking piece.

* * * * *